US012486008B2

(12) United States Patent
Oakes et al.

(10) Patent No.: US 12,486,008 B2
(45) Date of Patent: Dec. 2, 2025

(54) BONDED WINDSHIELD SYSTEM

(71) Applicant: Taylor Made Group, LLC, Gloversville, NY (US)

(72) Inventors: Philip A. Oakes, Middle Grove, NY (US); Edward J. Erskine, Benson, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 571 days.

(21) Appl. No.: 17/951,192

(22) Filed: Sep. 23, 2022

(65) Prior Publication Data

US 2023/0091411 A1 Mar. 23, 2023

Related U.S. Application Data

(60) Provisional application No. 63/247,398, filed on Sep. 23, 2021.

(51) Int. Cl.
*B63B 73/46* (2020.01)
*B63B 19/02* (2006.01)

(52) U.S. Cl.
CPC ..... *B63B 73/46* (2020.01); *B63B 19/02* (2013.01)

(58) Field of Classification Search
CPC ..... B63B 19/00; B63B 19/02; B63B 73/00; B63B 73/40; B63B 73/46
USPC ..... 114/361, 364
See application file for complete search history.

(56) References Cited

U.S. PATENT DOCUMENTS

| | | | | |
|---|---|---|---|---|
| 4,815,410 | A | 3/1989 | Muhlberger | |
| 5,660,916 | A | 8/1997 | Sofie et al. | |
| 6,158,372 | A | 12/2000 | Erskine | |
| 7,281,485 | B1 * | 10/2007 | Bach | B63B 19/02 114/361 |
| 7,661,747 | B2 * | 2/2010 | Erskine | B63B 17/02 296/84.1 |
| 2008/0156247 | A1 | 7/2008 | Bach | |
| 2014/0190391 | A1 | 7/2014 | Dubé | |

OTHER PUBLICATIONS

International Search Report dated Jan. 23, 2023 issued in PCT International Patent Application No. PCT/US2022/044478, 4 pp.

* cited by examiner

*Primary Examiner* — Daniel V Venne
(74) *Attorney, Agent, or Firm* — NIXON & VANDERHYE P.C.

(57) ABSTRACT

A windshield system securable on a boat deck includes a bottom trim securable directly onto the boat deck, a top trim, and a vertical trim connected between the bottom trim and the top trim. A glass panel is secured to the bottom trim, the top trim and the vertical trim solely with an adhesive. The trim profiles significantly reduce processing and assembly work. The system is also intended to be fully bonded together without the use of mechanical fasteners.

14 Claims, 11 Drawing Sheets

BONDED WINDSHIELD SYSTEM

CROSS-REFERENCES TO RELATED APPLICATIONS

This application claims the benefit of U.S. Provisional Patent Application No. 63/247,398, filed Sep. 23, 2021, the entire content of which is herein incorporated by reference.

STATEMENT REGARDING FEDERALLY SPONSORED RESEARCH OR DEVELOPMENT (NOT APPLICABLE)

BACKGROUND

The invention relates to windshield systems and, more particularly, to a bonded windshield system suitable for marine applications.

It is a challenge to secure windshields to boat decks and the like due not only to the typically curved glass but also to the varying orientation of the glass across the sides and front of the windshield. Glass windshields typically are provided with a bottom trim member and a top trim member that are used to secure the glass to the boat deck and to provide a clean finish on the windshield. The trim parts conventionally include aluminum channels in which the glass is encapsulated in vinyl gaskets. A shortcoming with existing designs is the multiple parts and assembly requirements in using the vinyl gaskets and aluminum channels.

Other shortcomings with existing designs include the alignment and preparation of holes for receiving connectors, particularly in the corner joints. Existing designs are also subjected to stripped threads during manufacture and broken screw heads and are required to address unfinished, rough edges, trim mis-alignment, mis-aligned angle cuts, non-planar trim overlaps, scratches, rub marks, and bent ends from assembling overlapping u-channels, gasket cutting or gapping, and pounding trim and/or glass into place.

SUMMARY

It would thus be desirable to provide a windshield system that overcomes the problems associated with existing designs. According to the described embodiments, a windshield system may be constructed without holes and fasteners where the glass is bonded via an adhesive rather than being framed by encapsulation in vinyl gaskets and aluminum channels. Corner joints can similarly be secured via an adhesive. With the bonded construction, any or all of the glass edges can be exposed, which enhances the design. The resulting system is easier to manufacture and install and has a very clean and sleek appearance.

In an exemplary embodiment a windshield system securable on a boat deck includes a bottom trim securable directly onto the boat deck, a top trim, a vertical trim connected between the bottom trim and the top trim, and a glass panel secured to the bottom trim, the top trim and the vertical trim solely with a first adhesive.

The vertical trim may include a track that is configured to receive a second adhesive, and the bottom trim and the top trim may be secured to the vertical trim over the track. The vertical trim may include a notch, and an outer edge of the bottom trim and the top trim may be positioned in the notch. The system may further include foam tape interposed between the bottom trim and the glass panel, between the top trim and the glass panel, and between the vertical trim and the glass panel. The foam tape secured between the vertical trim and the glass panel may be thicker than the foam tape secured between the bottom trim and the glass panel and between the top trim and the glass panel. The bottom trim and the top trim may each include at least one channel configured to receive the first adhesive.

The vertical trim may include a channel.

The system may further include a door.

In another exemplary embodiment, a windshield system includes a starboard side (SS) frame set, a port side (PS) frame set, and a door. The starboard side frame set includes an SS bottom trim, an SS top trim, an SS vertical trim, and an SS glass panel secured to the SS bottom trim, the SS top trim and the SS vertical trim solely with a first adhesive. The port side frame set includes a PS bottom trim, a PS top trim, a PS vertical trim, and a PS glass panel secured to the PS bottom trim, the PS top trim and the PS vertical trim solely with a second adhesive. The door is pivotally connected to one of the starboard side frame set and the port side frame set between the starboard side frame set and the port side frame set. The door includes a door bottom trim, a door top trim, a door vertical trim, and a door glass panel secured to the door bottom trim, the door top trim and the door vertical trim solely with a third adhesive.

The SS vertical trim, the PS vertical trim, and the door vertical trim each may include a track that is configured to receive a fourth adhesive, and the SS bottom trim and the SS top trim may be secured to the SS vertical trim over the track, the PS bottom trim and the PS top trim may be secured to the PS vertical trim over the track, and the door bottom trim and the door top trim may be secured to the door vertical trim over the track. The SS vertical trim, the PS vertical trim, and the door vertical trim may each include a notch, and outer edges of the SS bottom trim and the SS top trim may be positioned in the notch of the SS vertical trim, outer edges of the PS bottom trim and the PS top trim may be positioned in the notch of the PS vertical trim, and outer edges of the door bottom trim and the door top trim may be positioned in the notch of the door vertical trim.

At least one of the SS vertical trim, the PS vertical trim and the door vertical trim may include a channel The system may further include a hinge connected between the door and the one of the starboard side frame set and the port side frame set. The door vertical trim on a side of the door opposite from the hinge may include a latch panel. The one of the SS vertical trim and the PS vertical trim that is positioned adjacent the latch panel may include an underlap that is configured to support the door in a closed position.

In yet another exemplary embodiment, a method of assembling a windshield system includes the steps of setting a vertical trim that includes a track into a jig; applying an adhesive in the track; securing a bottom trim to the vertical trim; securing a top trim to the vertical trim, wherein the bottom trim, the top trim and the vertical trim define a windshield frame; applying foam tape to the vertical trim, the bottom trim and the top trim; applying an adhesive to the vertical trim, the bottom trim and the top trim; and securing a glass panel in the windshield frame via the adhesive.

BRIEF DESCRIPTION OF THE DRAWINGS

These and other aspects and advantages will be described in detail with reference to the accompanying drawings, in which.

DETAILED DESCRIPTION

Figure 1:
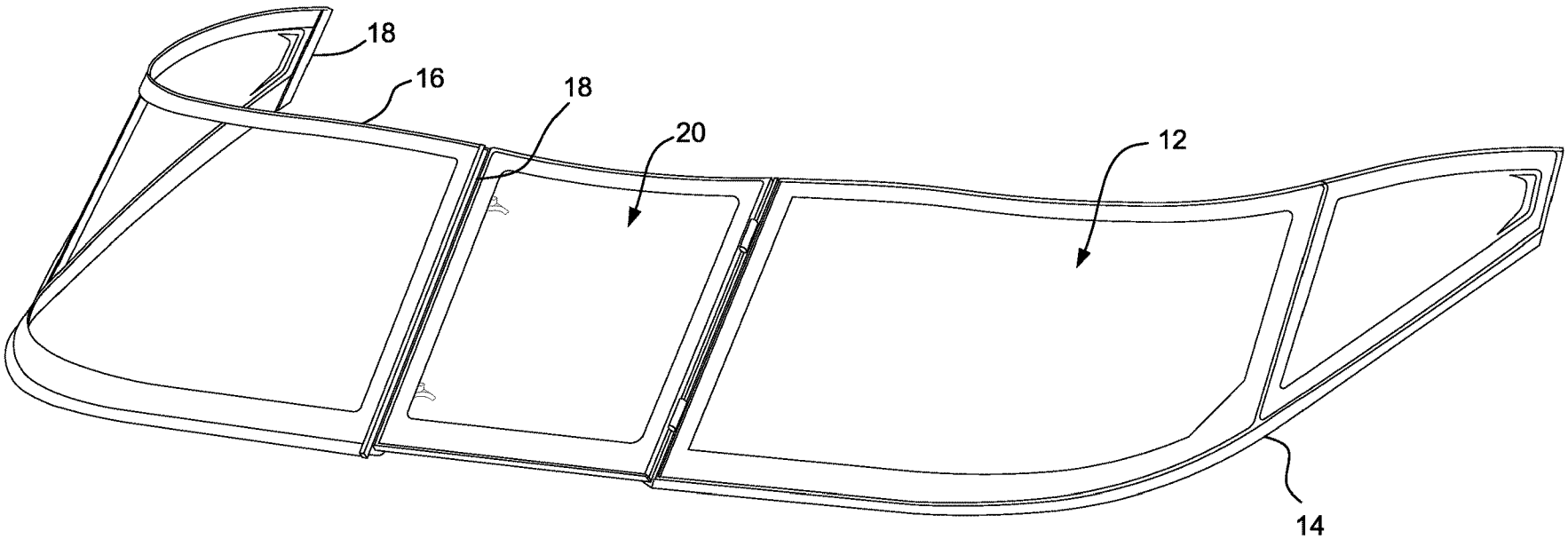
FIG. 1 is a perspective view of an exemplary windshield system of the described embodiments.

FIG. 1 is a perspective view of an exemplary windshield system of the described embodiments. The windshield system includes glass 12, which may be formed in multiple pieces, a bottom trim 14, a top trim 16, and a vertical trim member 18. The windshield system may also include a hinged door 20, enabling passengers to pass through a center of the windshield. In some embodiments, the door 20 may be hinged to one of the vertical trims 18 via friction hinges recessed into the vertical trim. With a multi-piece windshield, each piece of the windshield may include top, bottom and vertical trims to form a set. For example, the framework and two glass panels to the right of the door 20 in FIG. 1 are a set. The set includes a bottom trim 14, a top trim 16, three vertical trim members 18, and two glass panels. As will be described in more detail below, the various trims are assembled with overlapping parts in order to facilitate assembly. The system may also include similar trim parts for outermost ends of the windshield system.

Exemplary trim cross-sections are shown in FIGS. 2A-2H. The trim members are generally extruded and are bent to match the windshield and the mounting area. The bottom trim 14 shown in FIG. 2A includes an arcuate or J-shaped section 14*a* as described in U.S. Pat. No. 4,815,410, the content of which is hereby incorporated by reference. The J-shape facilitates the connection of the trim to the boat deck while accommodating variations in the angle of the windshield to the deck. The bottom trim 14 may include a vinyl cover 14*b* that conceals any connectors that secure the trim to the boat deck.

A flat section 14*c* provides surface area on which to bond the glass 12 with an adhesive. In some embodiments, the flat section 14*c* includes channels 14*d* for receiving additional adhesive material and also provide space for the adhesive to expand during assembly.

Figure 2A:
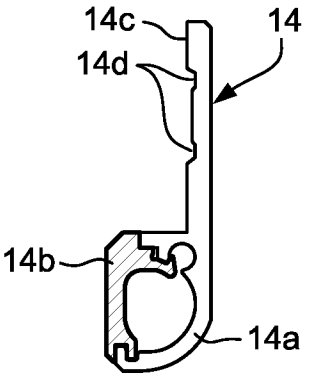
FIGS. 2A-2H show exemplary trim cross-sections.
Figure 2B:
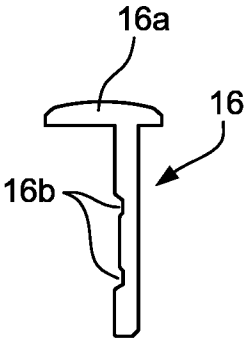

The cross-section of an exemplary top trim 16 is shown in FIG. 2B. The top trim 16 includes a low-profile top portion 16*a*, and in some embodiments, similarly includes channels 16*b* to receive adhesive. The top trim 16 can also be used as a door bottom trim in the event that the extra channels are not needed.

Figure 2C:
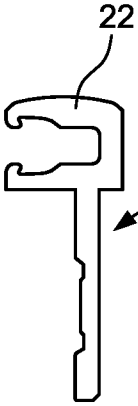

FIG. 2C shows a cross-section of an alternative top trim 16' including a top channel 22 for securing accessories such as a boat cover or the like.

Figure 2D:
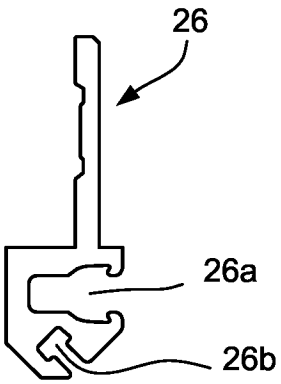

FIG. 2D is a cross-section of an exemplary bottom trim 26 for the door 20. The exemplary bottom trim 26 may include a channel 26*a* for securing accessories as well as a channel 26*b* for attaching a deck seal.

Figure 2E:
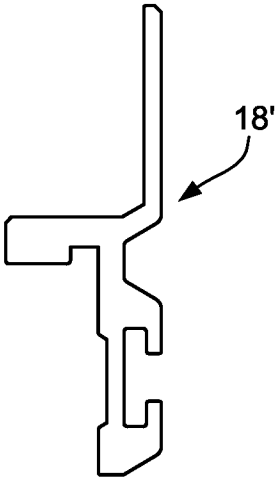
Figure 2F:
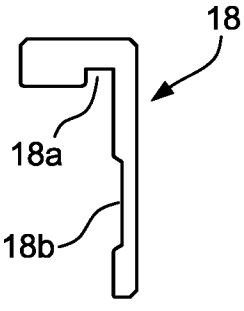
Figure 3:
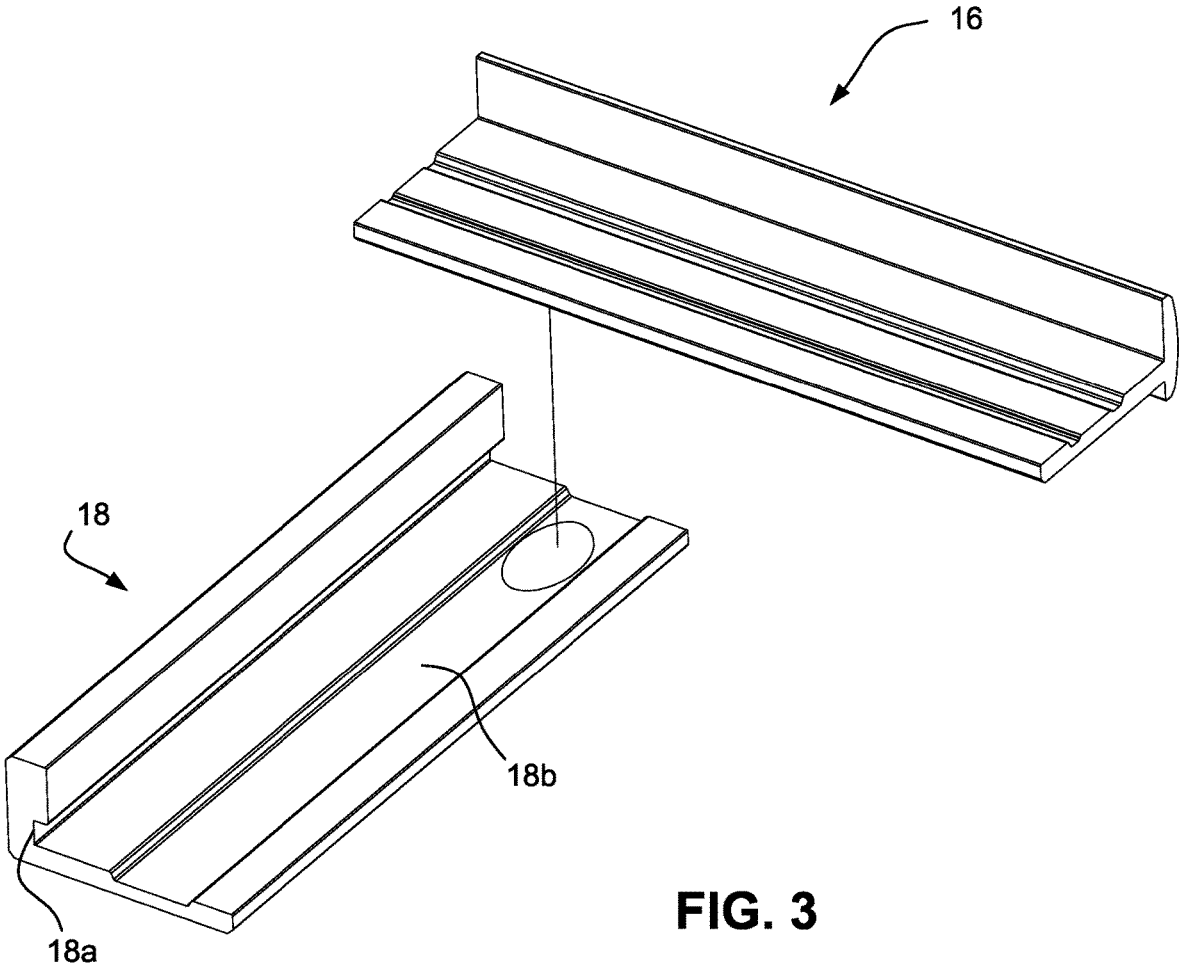
FIGS. 3 and 4 show the top trim and the bottom trim bonded to the vertical trim in an overlapping arrangement via an adhesive.
Figure 4:
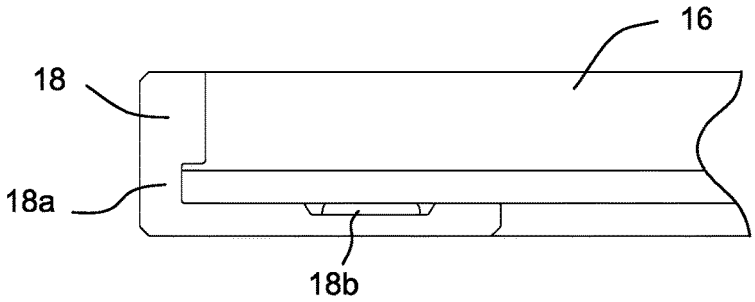

Exemplary vertical trims are shown in FIGS. 2E-2H. FIG. 2F shows the basic vertical trim member 18 that extends between the top trim 16 and the bottom trim 14. With reference to FIGS. 3 and 4, the top trim 16 (and the bottom trim 14) are bonded to the vertical trim 18 in an overlapping arrangement via an adhesive. The vertical trim 18 includes a notch 18*a* that receives an outer edge of the top trim 16 (or bottom trim 14). The vertical trim 18 also includes a track 18*b* for an adhesive to secure the bottom trim 14 and the top trim 16. FIG. 4 shows the outer edge of the top trim 16 flush with the notch 18*a* in the vertical trim 18.

In order to accommodate the overlap and provide a flush surface to secure the glass 12, the vertical trim 18 is provided with ¼ inch foam tape while the top and bottom trims are provided with ⅛ inch foam tape. The thicker foam tape on the vertical trim 18 accommodates the thickness of the bottom trim 14 and the top trim 16 overlaying the vertical trim 18. The glass 12 is subsequently glued to the bottom trim 14, the top trim 16 and the vertical trim 18.

Figure 2G:
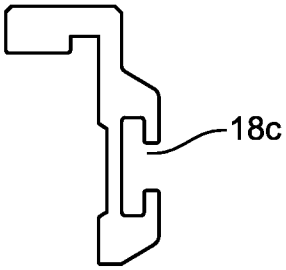
Figure 2H:
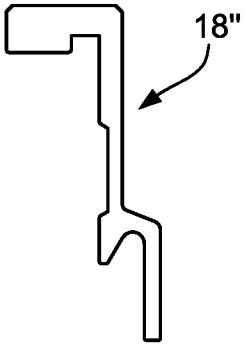

Alternative exemplary vertical trim members are shown in FIGS. 2E, 2G and 2H. FIG. 2G shows the vertical trim 18 including a channel 18*c* such as a T-track as shown for receiving adjustable support bars and other accessories. FIG. 2E shows a vertical trim 18' with an underlap associated with the door 20. FIG. 2H shows yet another alternative vertical trim 18" for the door latch. Each of the various constructions may include the notch 18*a* and the track 18*b* for receiving and securing the bottom trim 14 and the top trim 16.

Figure 5:
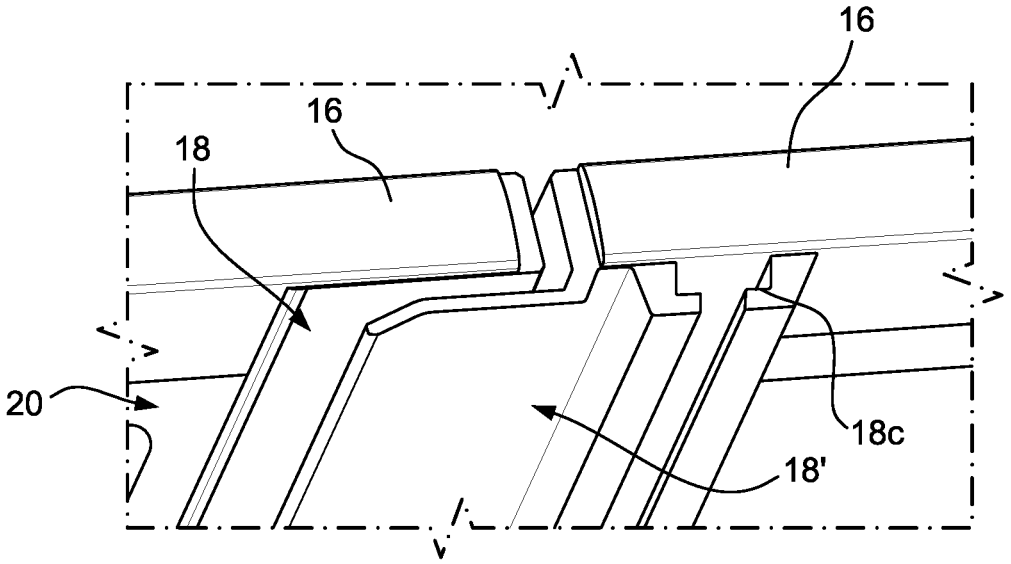
FIGS. 5-8 show the various trim members as assembled.
Figure 6:
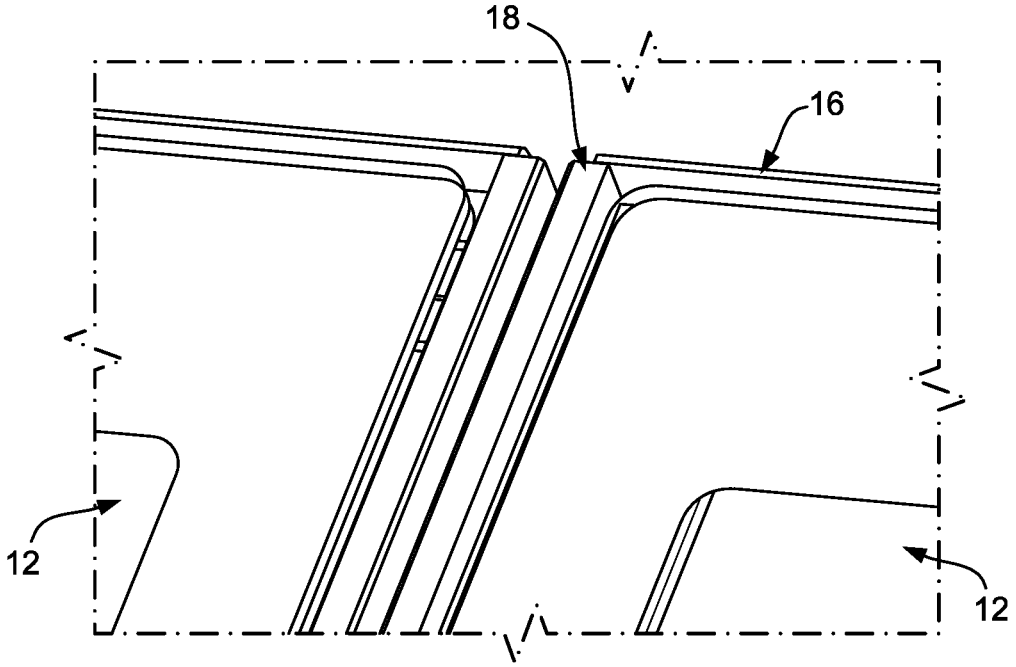

FIGS. 5-8 show the various trim members as assembled. FIG. 5 is an inside view showing the door 20 including the vertical trim 18 and the underlap vertical trim 18' that receives the door 20 in the closed position. The underlap vertical trim 18' is shown with the channel 18*c*. FIG. 6 is also an inside view showing abutting pieces of a multi-piece windshield with the low-profile top trim 16 and the vertical trim 18.

Figure 7:
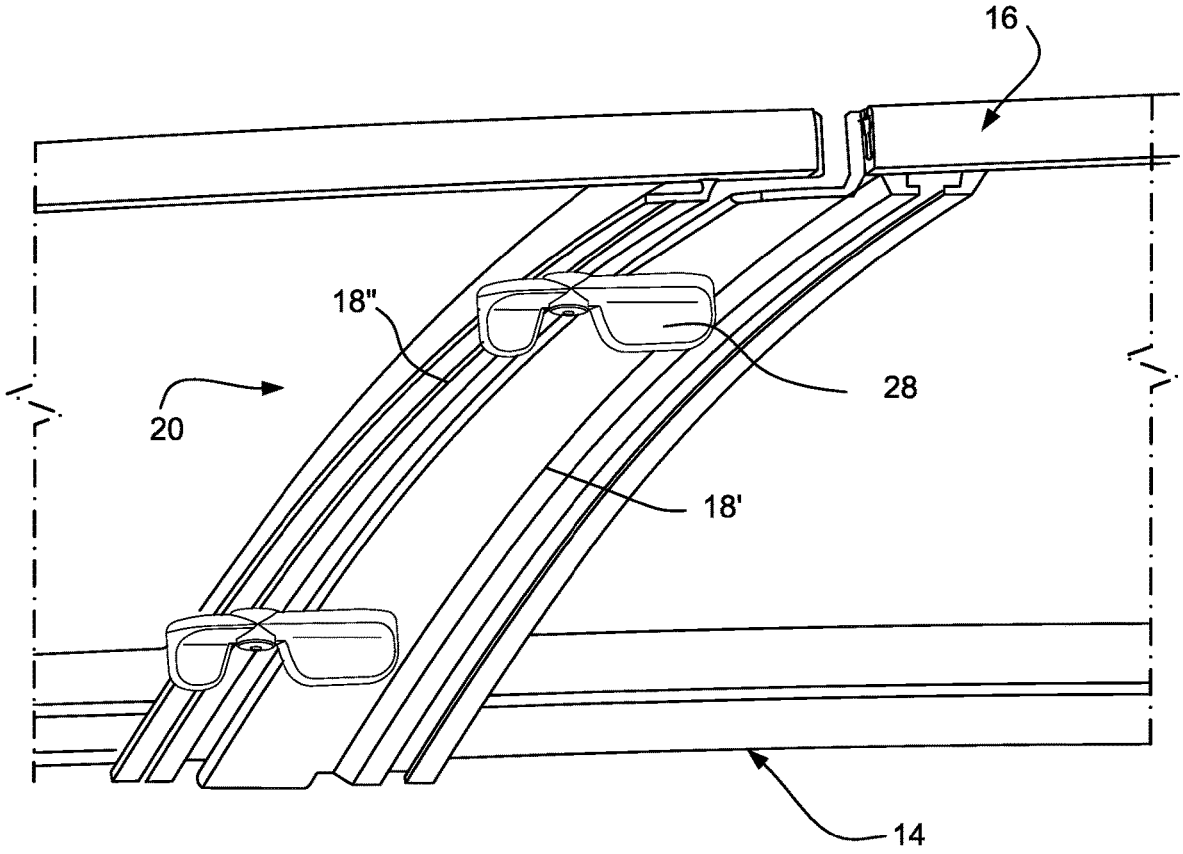

FIG. 7 is a wider view of the door 20 and associated vertical trim members 18', 18". The door latch vertical trim 18" may provide space to receive riveted turn latches 28 to secure the door 20 in the closed position. The underlap door flange trim 18' keeps the outside profile of the system clean and streamlined. Other features such as a handle for closing may similarly be integrated with the trim.

Figure 8:
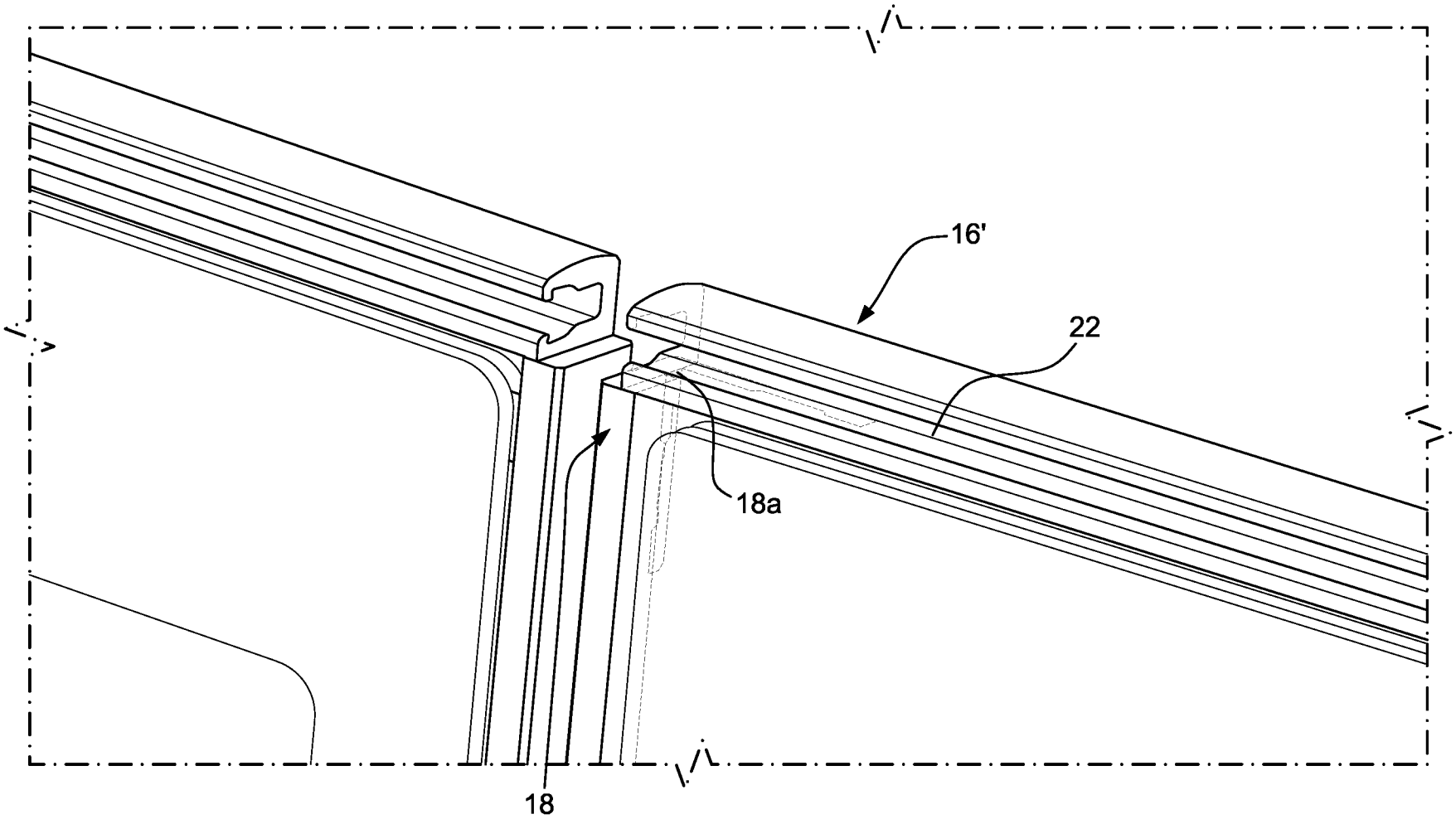
Figure 9:
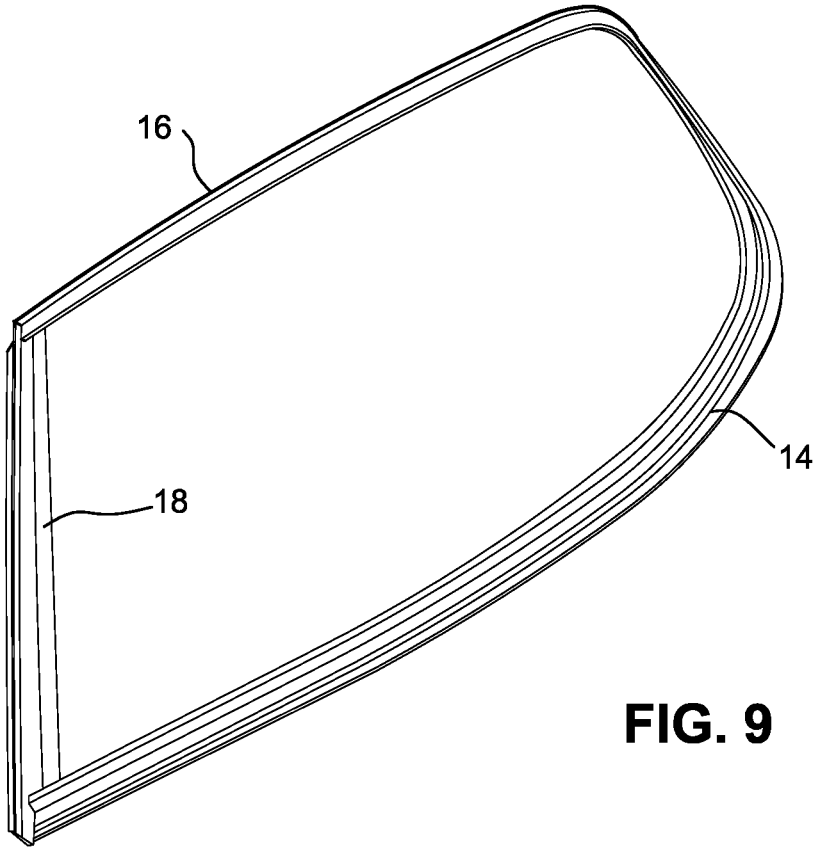
FIGS. 9-16 show an exemplary manufacturing process.

FIG. 8 provides a shadow view of the interaction between the top trim 16' and the vertical trim 18. Note how the top trim 16' is tucked into the notch 18*a* in the vertical trim 18.

Figure 10:
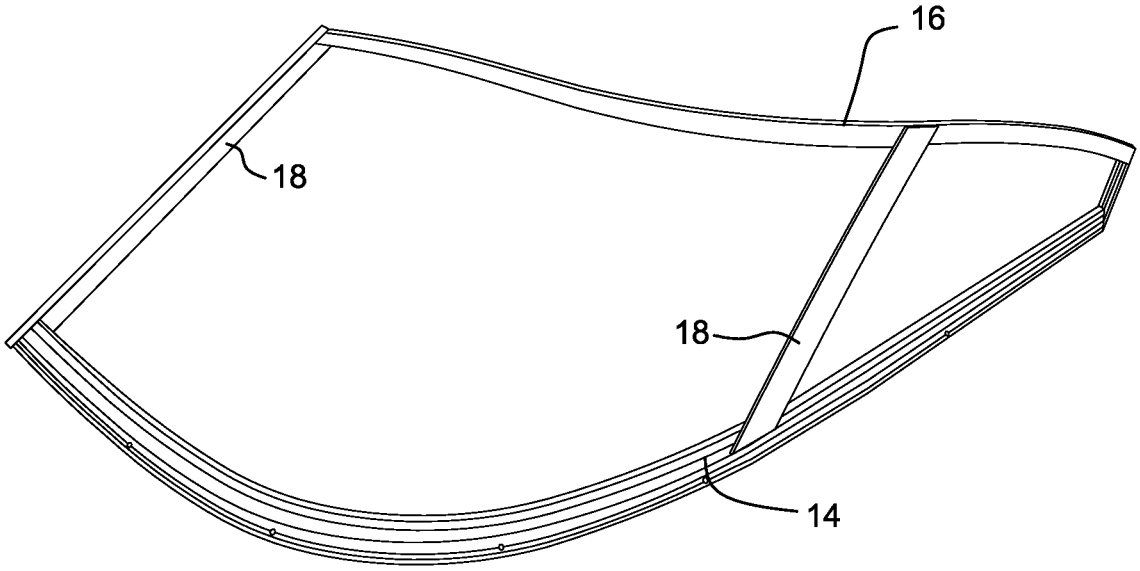

An exemplary manufacturing process will be described with reference to FIGS. 9-16. The system is first set up in a bonding jig, and the vertical trim members 18 are placed. Adhesive is applied to the tracks 18*b*, and the bottom trim 14 and the top trim 16 are placed and clamped. Once the adhesive is cured, the frame as shown in FIG. 10 is ready for glass or can be racked for future manufacturing processes.

Figure 11:
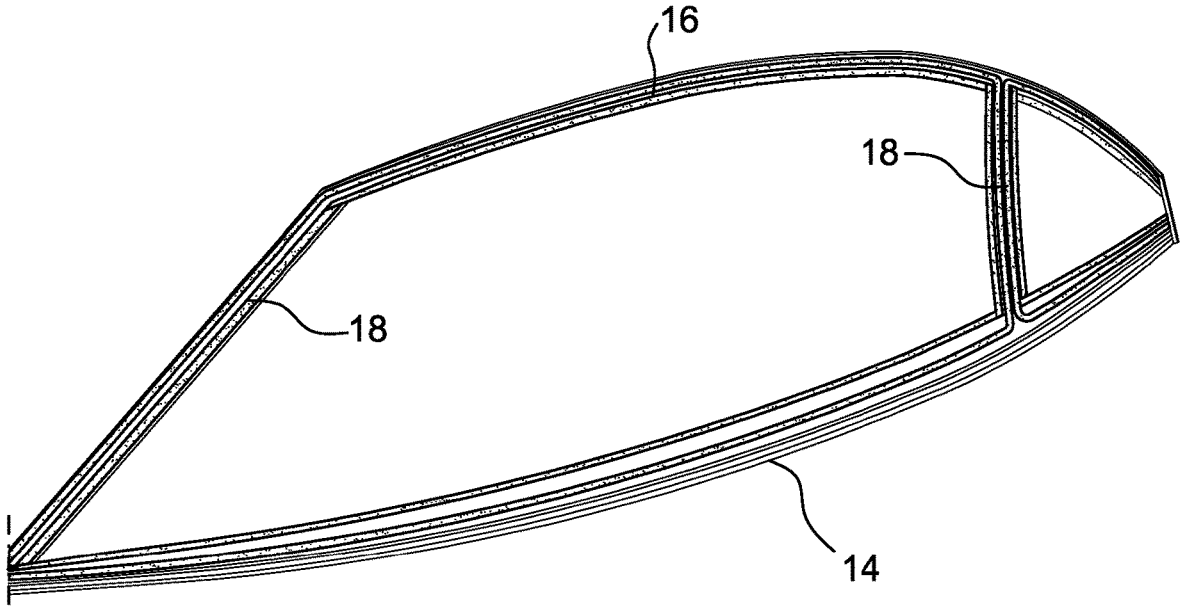
Figure 12:
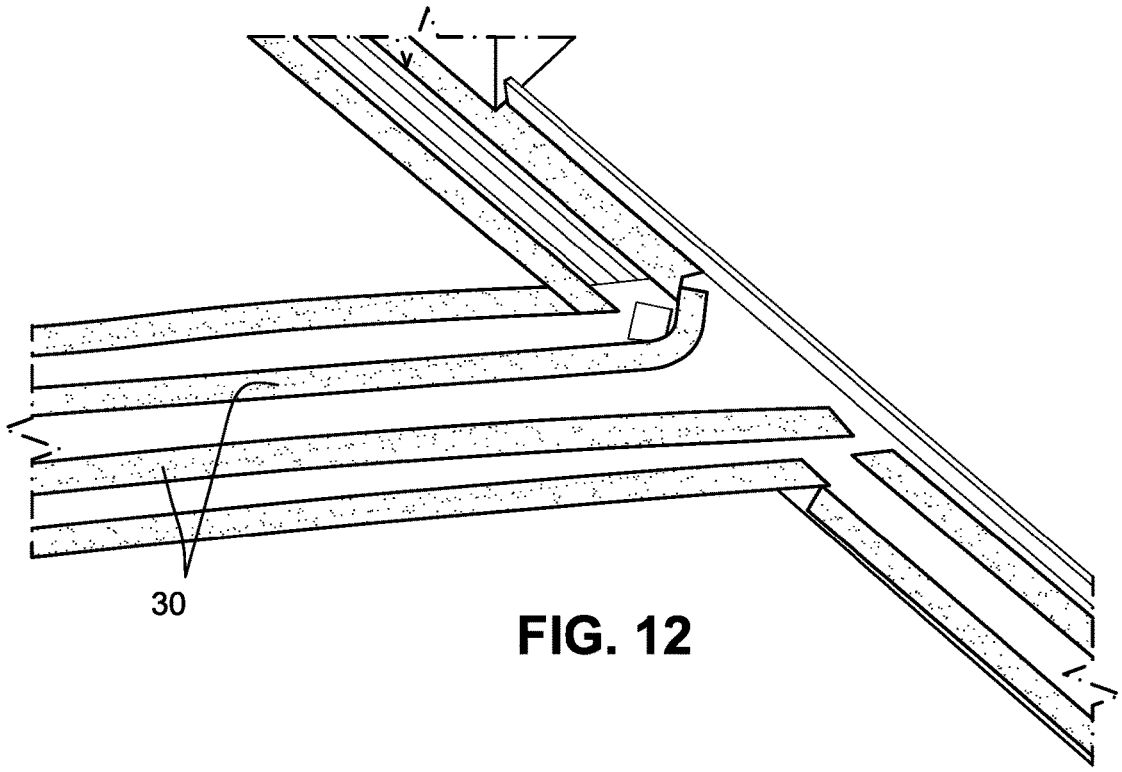
Figure 13:
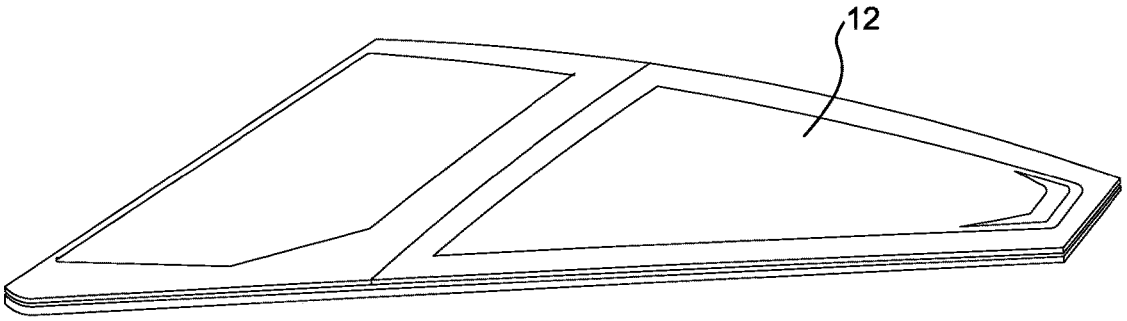
Figure 14:
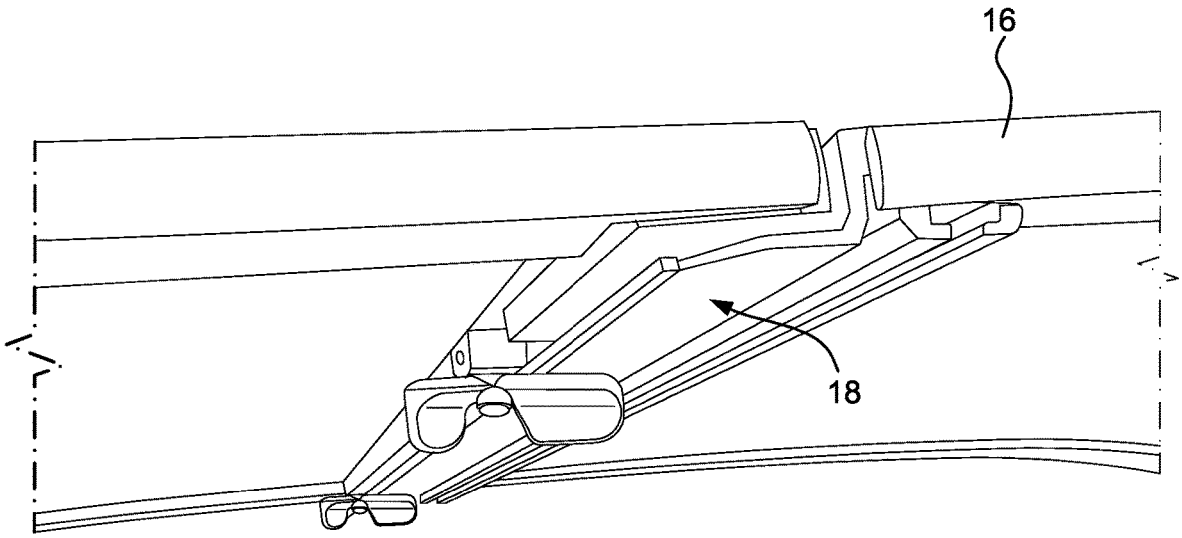
Figure 15:
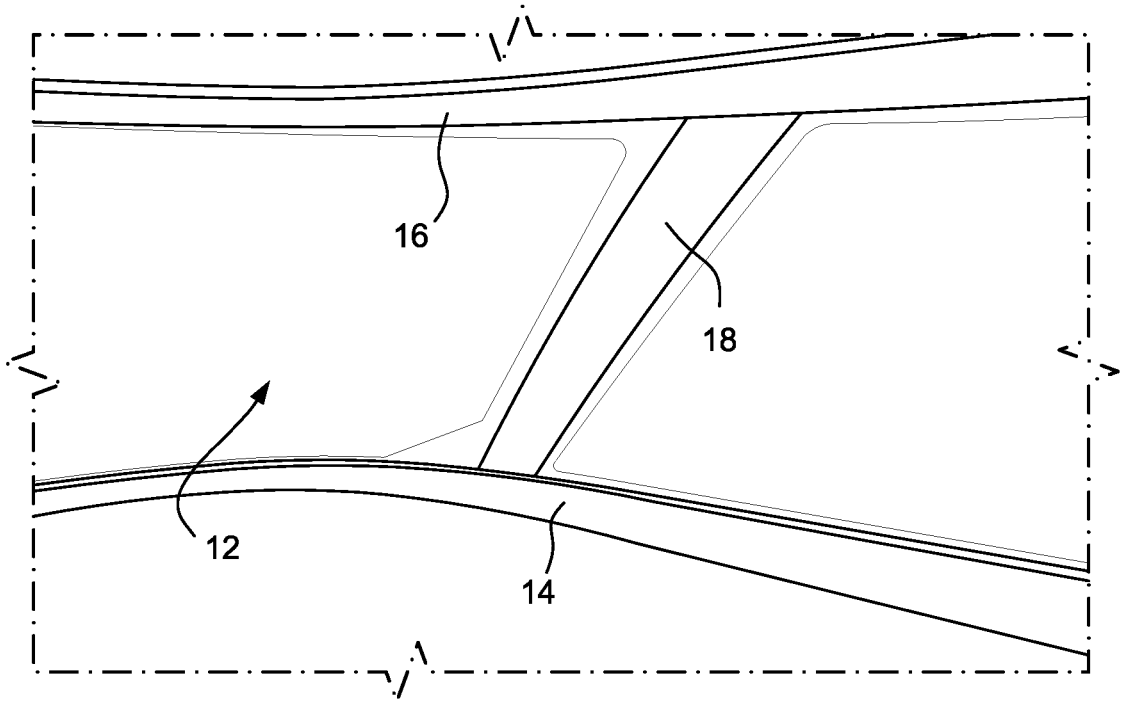
Figure 16:
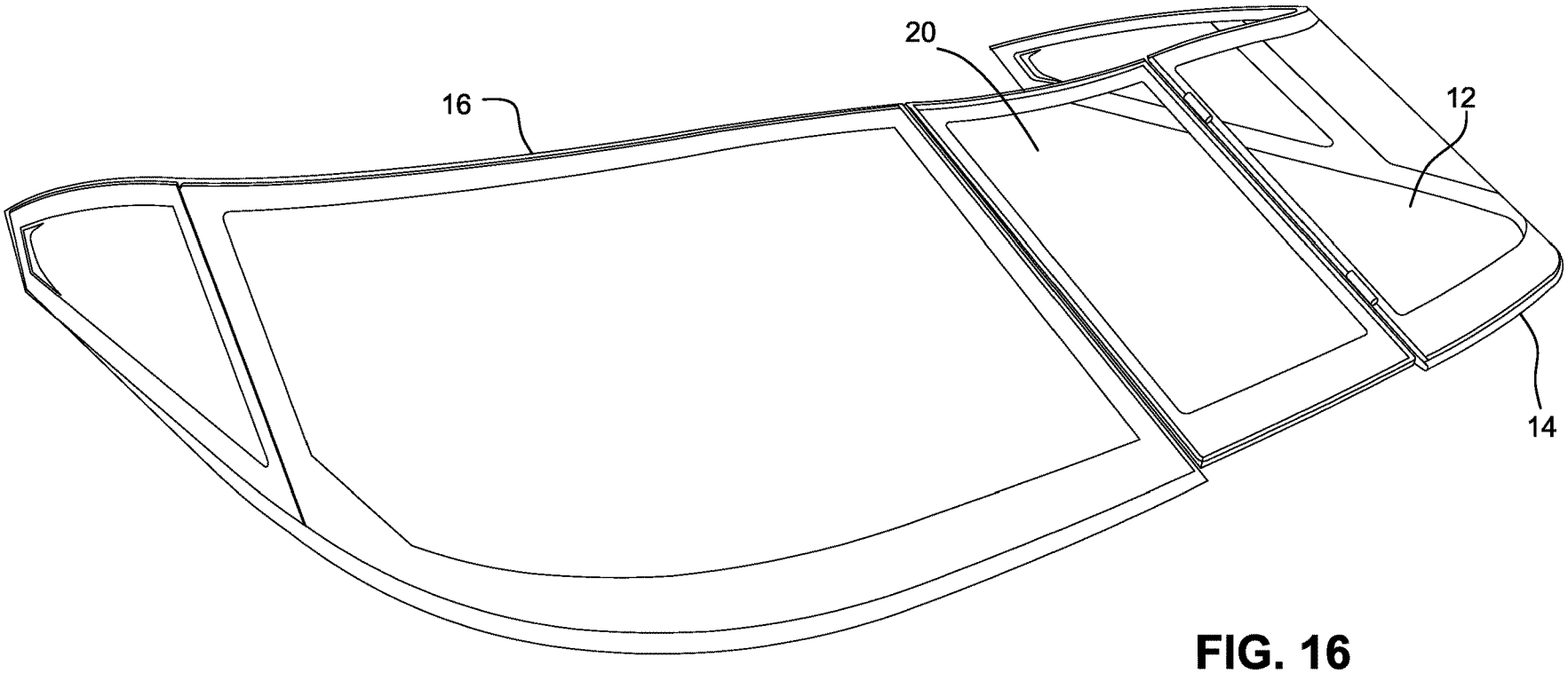

After the frame is bonded and cured, with reference to FIGS. 11-13, foam tape 30 is applied. As discussed above, the foam tape 30 applied to the vertical trim 18 is thicker than the foam tape 30 applied to the bottom trim 14 and the top trim 16 to provide a flush surface for the glass due to the overlapping configuration of the bottom trim 14 and the vertical trim 18 and the top trim 16 and the vertical trim 18. Adhesive is applied after the foam tape 30 to bond the glass to the frame. The foam tape 30 is used as a spacer for the glass and a wall to help prevent the adhesive from oozing behind the glass when glazing. The glass 12 is glazed and clamped into position. After the sets are cured, the windshield is cleaned up, assembled and inspected. Views of the final assembly are shown in FIGS. 14-16.

The bonded windshield system of the described embodiments advantageously secures the glass via an adhesive rather than being framed by encapsulation in vinyl gaskets and aluminum channels. The system also uses overlapping frame joints that eliminate the milling required in existing designs and also hides rough and mis-aligned cuts. Additionally, the corner joints are similarly glued, eliminating holes and fasteners. The glass becomes a structural subcomponent of the assembly.

The unique interwoven trim profiles are designed to significantly reduce processing and assembly work. The system is also intended to be fully bonded together without the use of mechanical fasteners (although fasteners could still be used if desired). The structural components are also designed to cover cut imperfections and keep overlapping bonding points parallel through the use of the recessed track. This combination greatly reduces or eliminates many potential sources of error and inconsistencies (back cuts, assembly screws, etc.), delivering a clean fit and finish, with better quality.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A windshield system securable on a boat deck, the windshield system comprising:

a bottom trim securable directly onto the boat deck;

a top trim; and a vertical trim connected between the bottom trim and the top trim; and a glass panel secured to the bottom trim, the top trim and the vertical trim solely with a first adhesive.

2. A windshield system according to claim 1, wherein the vertical trim includes a track that is configured to receive a second adhesive, and wherein the bottom trim and the top trim are secured to the vertical trim over the track.

3. A windshield system according to claim 2, wherein the vertical trim comprises a notch, and wherein an outer edge of the bottom trim and the top trim is positioned in the notch.

4. A windshield system according to claim 2, further comprising foam tape interposed between the bottom trim and the glass panel, between the top trim and the glass panel, and between the vertical trim and the glass panel, wherein the foam tape secured between the vertical trim and the glass panel is thicker than the foam tape secured between the bottom trim and the glass panel and between the top trim and the glass panel.

5. A windshield system according to claim 2, wherein the bottom trim and the top trim each comprise at least one channel configured to receive the first adhesive.

6. A windshield system according to claim 1, wherein the vertical trim comprises a channel.

7. A windshield system according to claim 1, further comprising a door.

8. A windshield system securable on a boat deck, the windshield system comprising:

a starboard side (SS) frame set including an SS bottom trim, an SS top trim, an SS vertical trim, and an SS glass panel secured to the SS bottom trim, the SS top trim and the SS vertical trim solely with a first adhesive;

a port side (PS) frame set including a PS bottom trim, a PS top trim, a PS vertical trim, and a PS glass panel secured to the PS bottom trim, the PS top trim and the PS vertical trim solely with a second adhesive; and a door pivotally connected to one of the starboard side frame set and the port side frame set between the starboard side frame set and the port side frame set, the door comprising a door bottom trim, a door top trim, a door vertical trim, and a door glass panel secured to the door bottom trim, the door top trim and the door vertical trim solely with a third adhesive.

9. A windshield system according to claim 8, wherein the SS vertical trim, the PS vertical trim, and the door vertical trim each includes a track that is configured to receive a fourth adhesive, and wherein the SS bottom trim and the SS top trim are secured to the SS vertical trim over the track, the PS bottom trim and the PS top trim are secured to the PS vertical trim over the track, and the door bottom trim and the door top trim are secured to the door vertical trim over the track.

10. A windshield system according to claim 9, wherein the SS vertical trim, the PS vertical trim, and the door vertical trim each comprises a notch, and wherein outer edges of the SS bottom trim and the SS top trim are positioned in the notch of the SS vertical trim, outer edges of the PS bottom trim and the PS top trim are positioned in the notch of the PS vertical trim, and outer edges of the door bottom trim and the door top trim are positioned in the notch of the door vertical trim.

11. A windshield system according to claim 8, wherein at least one of the SS vertical trim, the PS vertical trim and the door vertical trim comprises a channel.

12. A windshield system according to claim 8, further comprising a hinge connected between the door and the one of the starboard side frame set and the port side frame set.

13. A windshield system according to claim 12, wherein the door vertical trim on a side of the door opposite from the hinge comprises a latch panel.

14. A windshield system according to claim 13, wherein the one of the SS vertical trim and the PS vertical trim that is positioned adjacent the latch panel comprises an underlap that is configured to support the door in a closed position.

* * * * *